United States Patent [19]

Chihara et al.

[11] 4,041,691

[45] Aug. 16, 1977

[54] ELECTRONIC TIMEPIECE BATTERY MONITORING CIRCUIT

[75] Inventors: Hiroyuki Chihara; Yasushi Okada, both of Suwa, Japan

[73] Assignee: Kabushiki Kaisha Suwa Seikosha, Tokyo, Japan

[21] Appl. No.: 641,046

[22] Filed: Dec. 15, 1975

[30] Foreign Application Priority Data

Dec. 13, 1974 Japan ..... 49-143170

[51] Int. Cl.[2] ..... G04C 3/00; G08B 21/00

[52] U.S. Cl. ..... 58/23 BA; 58/152 H; 136/24; 340/249

[58] Field of Search ..... 58/23 A, 23 BA, 50 R, 58/152 H; 136/24, 30, 107, 116; 317/31; 320/13, 14; 340/248 R, 248 A, 249

[56] References Cited

U.S. PATENT DOCUMENTS

| | | | |
|---|---|---|---|
| 3,118,100 | 1/1964 | Chreitzberg | 320/13 |
| 3,816,177 | 6/1974 | Walsh | 136/30 |
| 3,898,790 | 8/1975 | Takamune et al. | 58/152 H |

*Primary Examiner*—E. S. Jackmon

*Attorney, Agent, or Firm*—Blum, Moscovitz, Friedman & Kaplan

[57] ABSTRACT

A battery monitoring circuit wherein the voltage discharge characteristic of a battery is utilized to facilitate detection of the impending failure of a battery is provided. The electronic timepiece includes a display device for displaying time in response to timekeeping signals applied thereto and is further adapted to indicate a voltage level representative of impending failure of a battery in response to an indication signal applied thereto. The battery is adapted to deliver at least two characteristic voltage levels, the first voltage level corresponding to a first plateau of discharge, and the second voltage level corresponding to a last plateau of discharge being sustained essentially at the second voltage level for a predetermined interval of time. A battery detection circuit detects the second voltage and in response thereto produces an indication signal, and timekeeping circuitry is provided for producing timekeeping signals in response to being energized at both characteristic voltage levels of the battery.

12 Claims, 5 Drawing Figures

ELECTRONIC TIMEPIECE BATTERY MONITORING CIRCUIT

BACKGROUND OF THE INVENTION

This invention is directed to an electronic timepiece battery monitoring circuit, and in particular to utilizing the voltage discharge characteristic of a battery to detect the impending failure thereof.

Heretofore, silver or mercury batteries have been the most commonly used power source in small sized electronic timepieces. Although silver and mercury batteries are capable of driving an electronic wristwatch at a predetermined voltage level over a considerable period of time, when the battery begins to fail, the voltage delivered thereby is dramatically reduced in a short amount of time. Accordingly, the rapid drop in voltage renders it extremely difficult to monitor the impending failure of such batteries and hence makes it difficult to replace the battery prior to the failure of same. Accordingly, a battery monitoring circuit wherein the period of time over which a power source deliverying voltage to timekeeping circuitry can be sufficiently increased to provide sufficient time to effect a replacement of the power source is desired.

SUMMARY OF THE INVENTION

Generally speaking, in accordance with the invention, an electronic timepiece battery monitoring circuit wherein the battery's voltage discharge characteristic is utilized to detect the impending failure thereof is provided. The electronic timepiece includes a display device for displaying time in response to timekeeping signals applied thereto and for indicating a voltage level representative of impending failure of the electronic timepiece power source in response to an indication signal applied thereto. An electro-chemical power source is utilized for delivering at least two characteristic voltage levels, the first voltage level corresponding to a first plateau of discharge and the second voltage level corresponding to a last plateau of discharge being sustained essentially at the second level voltage for a predetermined interval of time. A battery detecting circuit is adapted to detect the second voltage level and apply an indication signal to the display device. Timekeeping circuitry in response to being energized at both characteristic voltage levels applies timekeeping signals to the display device.

Accordingly, it is an object of this invention to provide an improved battery monitoring circuit in an electronic timepiece for detecting the impending failure of a battery.

A further object of the instant invention is to provide an electronic timepiece battery monitoring circuit wherein a battery is able to sustain a plateau of discharge at a reduced voltage level over an interval of time sufficient to provide for replacement of the battery prior to the ultimate failure of same.

Still a further object of the instant invention is to provide an improved battery monitoring circuit for an electronic timepiece wherein a volatile semi-conductor memory can be utilized, and the battery for energizing same can be replaced without any loss of the contents stored in the memory.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention reference is had to the following description taken in connection with the accompanying drawings, in which.

DETAILED DESCRIPTION OF THE PREFERRED EMBODIMENTS

Figure 1:
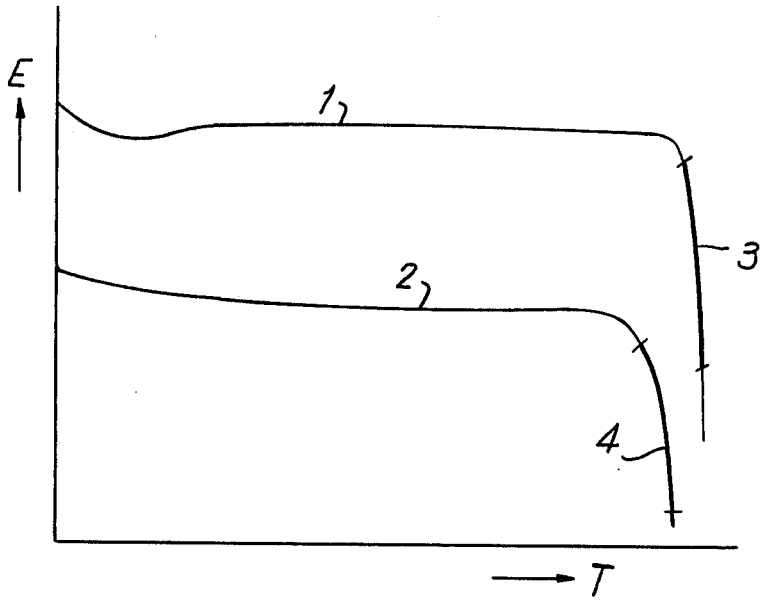
FIG. 1 PRIOR ART
FIG. 1 is a graphical illustration of the discharge characteristic of a silver battery and mercury battery, respectively, constructed in accordance with the prior art.

Reference is now made to FIG. 1, wherein the voltage discharge characteristic of a silver battery, depicted as curve 1, and a mercury battery, depicted as curve 2, are illustrated. At the end of the battery life, there is a rapid drop in the voltage level which drop occurs over a relatively short period of time. As illustrated by the thickened portions 3 and 4 of curves 1 and 2, respectively, the period Td for displaying the rapid decrease in the voltage level at the end of the battery life is very short. Moreover, when the operating characteristics of the elements utilized in a detection circuit are taken into account, the time over which the sudden decrease in potential can be monitored is further diminished. For example, in an electronic timepiece driven by a silver battery, once the voltage delivered by the battery falls below 1.2 volts, the electronic timepiece is no longer energized. Accordingly, if the voltage delivered falls to a level of 1.45 volts, at which same is first detected by a battery detecting circuit, the period over which the impending failure of the battery can be measured, until same falls below 1.2 volts would be on the order of two days when the current consumption of the electronic timepiece circuitry is of the order of 10 $\mu$A.

The instant invention avoids the difficulties noted above with respect to conventional mercury and silver batteries by providing a cell or battery, that is, an electro-chemical power source, having a discharge characteristic including at least two-stages or plateaus, the voltage level at both plateaus being sufficient to effect driving of the electronic timepiece circuitry, the last plateau being sustained over an extended period of time to provide a period Td for displaying the state of the battery just prior to the failure of same over a period ranging from one week to several months.

Figure 2:
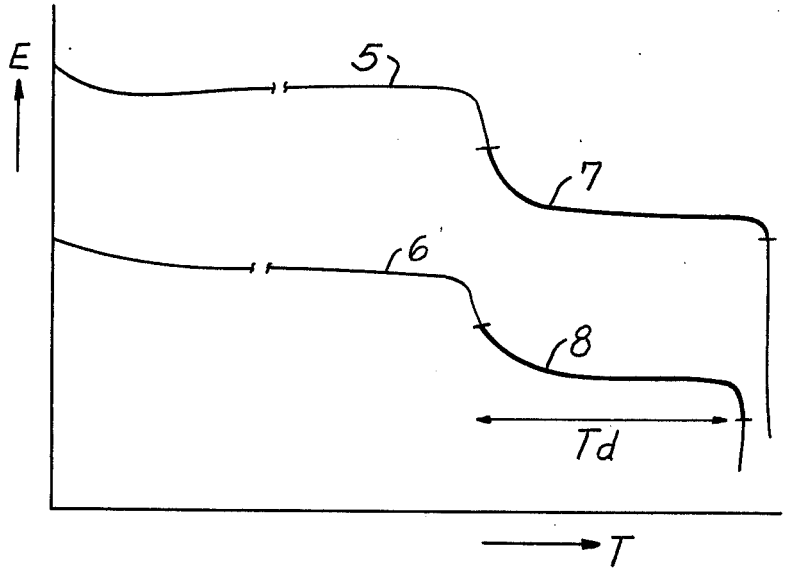
FIG. 2 is a graphical illustration of two-stage voltage characteristics for batteries constructed in accordance with the instant invention.

Referring to FIG. 2, the discharge characteristic of an electro-chemical power source constructed in accordance with the instant invention is depicted. Curves 5 and 6 represent dicharge characteristics of a silver battery and mercury battery, wherein the voltage level is abruptly lowered to 0.1 V to 0.5 V from the first normal operating voltage plateau to a further voltage plateau, wherein the voltage level is sustained until the failure of the power cell results in a sudden drop. Accordingly, the heavy line portions 7 and 8 of curves 5 and 6 illustrate the period T*d* over which the impending failure of the battery can be displayed. As is readily apparent from FIG. 2, difficulties heretofore encountered caused by variations in the voltage at which the voltage detection circuit was able to detect impending failure of the battery are eliminated by merely selecting a detection voltage somewhere between the respective first and last plateaus. There are several different ways to produce an electro-chemical cell or battery (the respective terms cell, battery and electro-chemical power source being utilized interchangably herein for purposes of describing either an electrochemical cell or battery formed by a plurality of cells for use in energizing an electronic wristwatch) having the two-plateau discharge characteristic illustrated in FIG. 2. It should be noted that the voltage, E, of the power source, under the use conditions considered herein, will be close to the open circuit voltage since the rate of discharge is extremely low.

A preferred method for forming a power source to obtain a two-plateau discharge curve is the use of different electrode materials in one of the electrodes of the cell. When the electrode material which provides the higher voltage is exhausted, the other electrode material will begin to function and deliver a lower voltage. A suitable combination is silver oxide or nickel oxide as the positive electrode and a mixture of cadmium and zinc as a negative electrode. Conveniently, from 80 to 95% of the negative electrode capacity could be in the form of zince and from 5% to 20% in the form of cadmium. The capacity of the positive electrode should be sufficient to discharge both the zince and the cadmium in the negative electrode. In the first stage of discharge, the reaction of the positive electrode of the silver oxide-zinc cell is as follows: $Ag_2O + H_2O + 2e^- \rightarrow 2Ag + 20H^-$. The electromotive force, EMF, of this reaction is 0.34V against an arbitrary standard. The reaction at the negative electrode is $Zn + 20H^- \rightarrow ZnO + H_2O + 2e^-$. The EMF for the zinc electrode against the same arbitrary standard is 1.24V. Accordingly, the sum of the two electrode potentials is the EMF of the entire cell and is therefore 1.58V. When the zinc is exhausted, the silver oxide will discharge against the cadmium, giving a voltage which is about 0.45V lower, the discharge curve having the same form as that illustrated in FIG. 2. Moreover, the length of time during which the power source would provide the lower voltage would be ample for effecting replacement of the power source in the electronic timepiece. It is further noted that if more than two metals are combined in the negative electrode, more than two voltage levels or plateaus would be obtained. It is further noted that the same effect can be obtained by using a combination of metal oxides in the positive electrode. Such a combination could be nickel oxide with silver oxide or with mercuric oxide.

A further method of obtaining a two-level discharge characteristic (so far as voltage is concerned) is through control of the relative quantities of electrochemically-active materials in the respective electrodes. Taking the silver oxide-zinc cell as an example, the silver oxide being the positive electrode and the zine being the negative electrode, the quantity of zinc in the negative electrode may, deliberately, be made less than the stoichiometric quantity in the positive electrode. Cells are conventionally constructed in this fashion in order to avoid leakage of the electrolyte. Conversely, if the quantity of zinc in the negative electrode is greater than that needed to discharge the silver oxide in the positive electrode, the two-level discharge curve shown in FIG. 2 can be obtained. The reason for this type of discharge can be seen by referring to the analysis of the electrochemical reactions occurring in cell being the same as those detailed above for the preferred example. Accordingly, the sum of the two electrode potentials is the EMF of the entire cell and as noted above is 1.58V. If the quantity of zinc is increased in order to obtain the two-level discharge characteristic illustrated in FIG. 2, the silver oxide in the positive electrode will be exhausted first with the result that the EMF of the cell will then be only 1.24V, the EMF of the negative electrode alone. As the discharge proceeds, the zince is eventually exhausted, at which point the cell voltage drops suddenly and the display of the second or last stage of the power cell characteristic is terminated.

In a conventional electro-chemical power source construction in which zinc is exhausted first, the EMF of 1.58V will be lowered to 0.34V upon exhaustion of the zinc, the residual EMF being that of the positive electrode alone, the discharge curve characteristic illustrated in FIG. 1 depicting such a result. As is evident, the voltage obtainable from the cell after the zinc is exhausted is not sufficient for the purpose stated herein.

A third technique for obtaining the discharge characteristic illustrated in FIG. 2 is to connect several cells in series and provide one of the cells with a capacity (in terms of ampere-hours) lower than the other cells. For example, if three conventional silver oxide-zinc cells are connected in series, and one of the cells has a capacity which is 80% of the others, then the battery voltage will be suddenly lowered from 4.74V to 3.50V when 80% of the rate of capacity (of the larger cells) has been exhausted. For the remaining 20% of the rate of capacity, the battery voltage will then be 3.50V.

One further variation of this last method, whereby the same effect is obtained, is the connection in series of three similar cells one of which has a larger current consumption than the remaining cells. Again a multi-level discharge curve can be obtained in addition to a two-level discharge characteristic. Moreover, the voltage variation at the last stage of discharge can vary between 0.1V and 0.5V so that it is not necessary for the battery-voltage detecting circuit to have great accuracy. Consequently, circuits for detection of the change in battery voltage are readily available.

Using a silver-oxide zinc cell of the type described above, it has been found that a two-level discharge characteristic in which the first stage is at 1.58V and the last stage is at 1.35V, can be readily obtained. Such voltage levels are ideal for utilizing the forward voltage of a light-emitting diode as well as for other cell-voltage or battery-voltage detection circuits.

A preferred form of the silver oxide-zinc cell is one in which the silver oxide electrode is charged up to the plus 2 level. During the first stage of discharge, the voltage holds constant at a value close to 1.86V due to the reaction $2AgO + Zn \rightarrow Ag_2O + ZnO$, EMF = 1.86. As will be seen from the above equation, the silver which initially has a valence of plus 2 is discharged from AgO to $Ag_2O$ which is the electrode described as usual in the conventional silver oxide-zince cell. The $Ag_2O$ then reacts with additional zinc as described above to give a voltage of 1.58V. The drop in voltage between the two levels is almost exactly 0.3V which is very convenient for detection. Moreover, the capacity of the cell is almost doubled that of the conventional cell which starts out with $Ag_2O$, and results in a longer lasting battery.

It should also be noted that cadmium can be substituted for zinc to give a very similar two-stage discharge characteristic curve but the voltage on each of the levels is about 0.45V lower than for the corresponding level with the silver oxide-zinc cell.

As detailed above, the combination of the battery having the voltage discharge characteristic illustrated in FIG. 2 with the battery detecting circuitry and electronic timepiece circuitry is particularly useful for providing an improved electronic wristwatch. Additionally, when an automatic frequency regulating memory circuit comprised of volatile semi-conductor memory elements is utilized, the battery can be replaced in sufficient time to avoid non-volatilization of the semi-conductor memory circuit. Moreover, by inhibiting the power consumption at the last stage of the battery, the period of time for replacing the battery without permitting the memory circuit to be non-volatilized can be extended.

Figure 3:
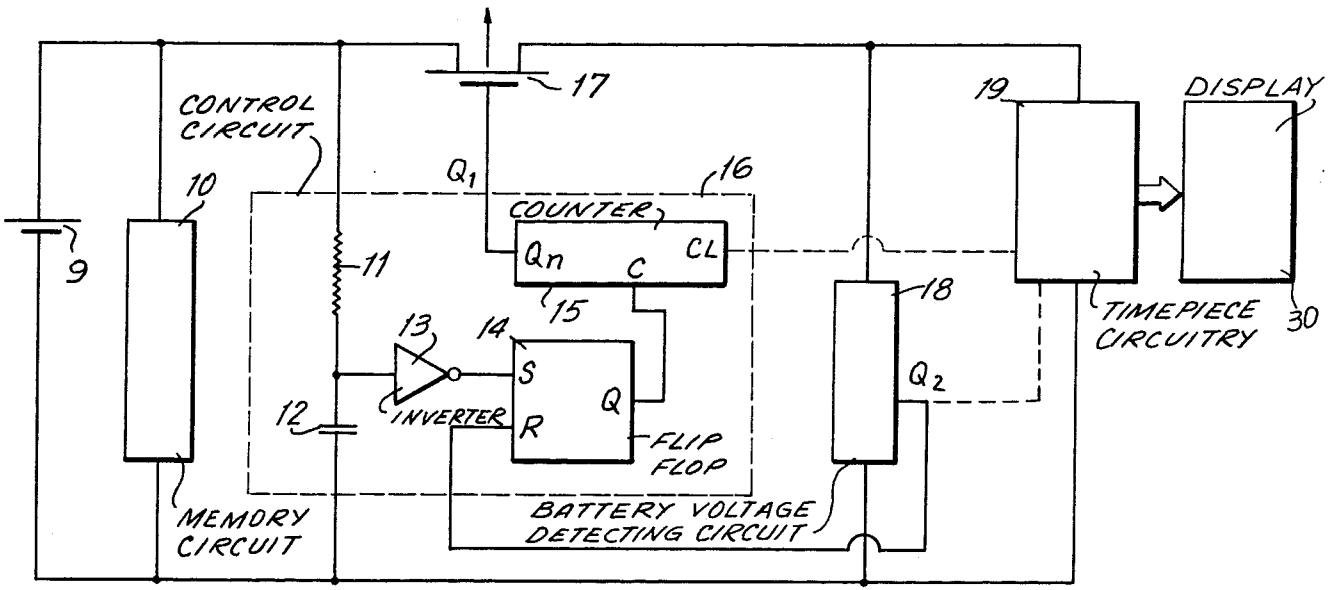
FIG. 3 is a block circuit diagram of an electronic timepiece battery monitoring circuit constructed in accordance with the instant invention.

Reference is now made to FIG. 3, wherein an electronic timepiece battery monitoring circuit constructed in accordance with the instant invention is depicted. The electronic timepiece includes timepiece circuitry 19 for applying timekeeping signals to a display 30. The timepiece circuitry includes a high frequency time standard and a divider circuit for producing low frequency timekeeping signals in response to signals produced by the high frequency time standard. In an electro-mechanical wristwatch, the timepiece circuitry applies timekeeping signals to an electro-mechanical transducer such as a step-motor, which step-motor in turn would be mechanically coupled to the display 30 comprised of display hands to be rotated thereby. In such and electro-mechanical wristwatch, the display 30 would include a further indication means, such as an LED for providing indication of a predetermined voltage level of the battery in a manner to be discussed more fully below. Alternatively, upon detecting a predetermined voltage level of the battery, the second-hand could be advanced at two-second intervals instead of one-second intervals in the manner disclosed in U.S. Pat. application Ser. No. 562,517, filed on Mar. 27, 1975. Alternatively, if a digital display electronic timepiece is contemplated, the timepiece circuitry, in addition to the divider circuit would include decoder and driving circuitry for receiving the timekeeping signals and applying same to the display 30 comprised of seven-segment digital display digits. In such event, appropriate timekeeping circuitry could be provided to apply a higher frequency signal to one of the seven-segment display digits in order to effect flickering of same and thereby provide an indication that the battery has been discharged to a predetermined voltage level where same should be replaced. The type of displays utilized to display time and provide an indication of the battery monitoring condition are many and are noted above by way of example only for an understanding of the instant invention.

A battery 9 is coupled through the source drain current path of an MOS switching transistor 17 to the timepiece circuitry 19 to effect energization of the timepiece circuitry when a 0 potential is applied to the gate electrode of the MOS transistor 17. Accordingly, upon the application of a 1 potential to the gate electrode of the MOS transistor 17, an open circuit is defined between the battery 9 and the timepiece circuitry 19. In order to control the frequency of the timekeeping signals produced by the timepiece circuitry 19, a permanent memory 10 comprised of volatile semi-conductor element is provided. A battery voltage detecting circuit 18 is coupled in parallel with the battery 9 and timepiece circuitry 19 and is adapted to produce a detection signal $Q_2$ upon detecting a drop in the voltage level of the battery 9. Accordingly, although the memory circuit 10, battery voltage detecting circuit 18 and timeiece circuitry 19 are energized by the battery when the switching transistor 17 is in a closed state, upon opening the switching transistor 17, only the memory circuit 10 will continue to be driven by the battery 9.

Control of the switching of MOS transistor 17 is effected by a control circuit, generally indicated as 16, comprised of a resistor 11, capacitor 12, inverter 13, flip-flop 14 and counter 15. As is explained in greater detail below, counter 15 applies a 1 binary state signal to the switching transistor 17 in response to the battery voltage detecting circuit 18 detecting a drop in the voltage level of the battery 9.

Figure 4:
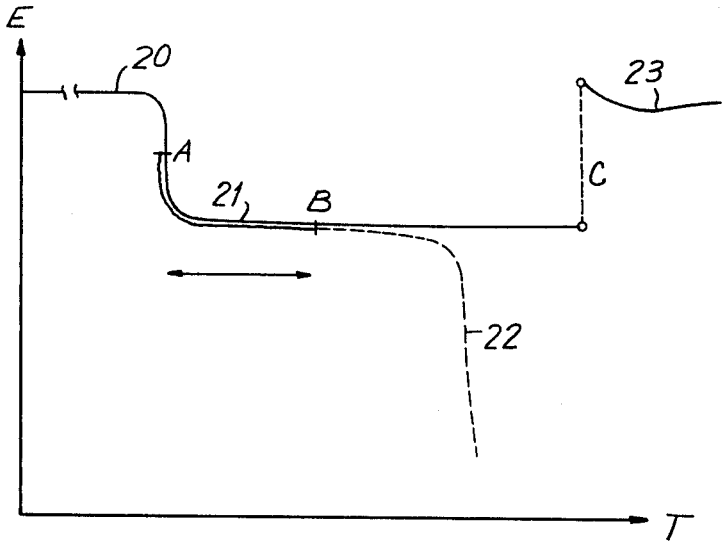
FIG. 4 is a graphical illustration of the voltage level delivered by the battery in the battery monitoring circuit depicted in FIG. 3.

Reference is now made to FIG. 4 wherein the operation of the battery monitoring circuit depicted in FIG. 3 and the objects obtained thereby is illustrated. By utilizing a battery having the same discharge characteristic as the batteries illustrated in FIG. 2, point A represents the time at which the battery voltage detecting circuit 18 detects a drop in potential from the first voltage level 20 to the second voltage level 21. At a predetermined interval of the time after the voltage drops to the second level and remains at that plateau, the MOS switching transistor 17 is opened, thereby defining an open circuit between the battery 9 and the timepiece circuitry and battery voltage detecting circuit. Accordingly, the only current consuming element remaining coupled to the battery 9 is the memory circuit 10, and in view of the small amount of current dissipated thereby, the battery is sustained a the plateau 21 until the point C where the battery 9 is replaced to provide a new voltage level 23. The dotted line 22 illustrates that complete battery failure would occur if the timepiece circuitry and battery voltage detecting circuit were not decoupled from the battery 9. Accordingly, by utilizing a small capacity auxiliary battery in the wristwatch, a remote power source or a large capacitor, the frequency adjustment information stored in the volatile memory circuit 10 is preserved during changing of the battery thereby avoiding nonvolatilization of the memory circuit 10 and hence any loss of the information stored in the memory.

Specifically, when the battery 9 remains at the voltage level corresponding to the first plateau of discharge 20 illustrated in FIG. 4, a 1 signal is applied by inverter 13 to the set terminal S of flip-flop 14 to thereby apply a 1 output Q to the C terminal of the counter 15 to prevent the counter 15 from counting and cause the output $Q_n$ to apply a 0 output signal $Q_1$ to the gate electrode of MOS transistor 17 and thereby maintain same in a closed state. At the point A between the voltage level corresponding to plateau 20 and the voltage level corresponding to plateau 21, the battery voltage detecting circuit 18 detects the change in voltage levels and applies a 1 output signal $Q_2$ to the reset terminal R of flip-flop 14 to thereby change the output $Q_n$ to a 0 binary state and thereby permit counter 15 to begin counting. Accordingly, a low frequency signal produced by the timepiece circuitry is applied to the counter 15, which counter can be set to a predetermined interval of time such as several days, a month or several months, whereafter same produces a 1 output signal $Q_1$ for referencing the control electrode of MOS transistor to a 1 state to open same. Accordingly, at the point B of the voltage level corresponding to the plateau 21, the battery voltage detecting circuit 18 and timepece circuitry 19 are decoupled from the battery 9 until the battery is replaced a the point C, whereafter the flip-flop 14 is once again set to 1 and effects a resetting of the counter 15 to produce a 0 output.

Accordingly, by setting the predetermined interval of time that it takes the counter to produce a 1 output $Q_1$ to be less than the interval of time over which the battery 21 could be sustainded at the plateau 21 before being entirely dissipated, as illustrated by the dotted line 22, only a small current consumption by the memory circuit 10 is utilized to thereby preserve the information stored until the battery is replaced. Additionally, the amount of time for replacing the battery is dramatically increased. It is noted that although non-volatile semiconductor memory circuits wherein information to be stored could be re-written in after changing the battery available, such memories are extremely expensive and hence less than completely satisfactory for use in an electronic wristwatch.

As detailed above, upon detecting the change in state of the battery 9, the output signal $Q_2$ is applied through the appropriate timepiece circuitry to the display 30 for providing an indication that the battery is operating at the lower voltage level, and accordingly that replacement of the battery is required. It is further noted that the control circuit 16 and MOS transistor 17 can be easily eliminated and there would still be provided a considerably extended period of time in which to advise the user to replace the battery.

Figure 5:
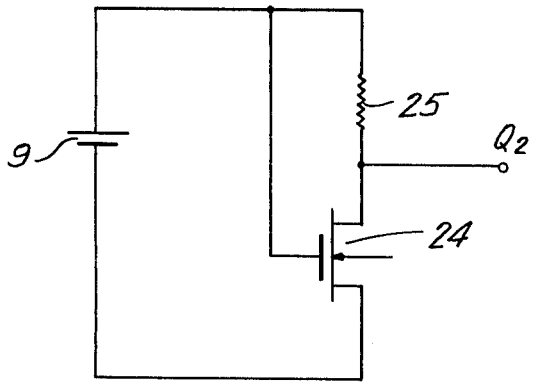
FIG. 5 is a detailed circuit diagram of the battery voltage detecting circuit depicted in FIG. 3.

Reference is now made to FIG. 5, wherein an example of a battery voltage detecting circuit particularly suitable for use with the battery monitoring circuit depicted in FIG. 3 is illustrated, like reference numerals being utilized to denote like elements illustrated in FIG. 3. An N-channel MOS transistor 24 is utilized to detect the voltage delivered by the battery 9. The gate electrode is referenced to the positive potential electrode of the battery and a variable resistor 25 is coupled between the drain electrode and positive potential of the gate electrode, the junction defined by the variable resistor 25 and drain electrode of MOS transistor 24 further defining the output terminal $W_2$ of the battery voltage detecting circuit. By varying the resistor 25, the threshold voltage of the MOS transistor 24 is varied. As long as the battery voltage delivered is substantially higher than the threshold voltage, the transistor 24 is maintained in a closed state, whereby the output terminal $Q_2$ is referenced to a low or 0 potential. However, when the battery voltage approximates the threshold voltage, the transitor is opened, thereby referencing the output terminal $Q_2$ to the higher potential to thereby produce a 1 binary signal.

Accordingly, the following advantages are realized by the instant invention. First, the interval of time over which the battery life can be monitored prior to the impending failure thereof is considerably extended thereby facilitating the replacement of the battery. Secondly, as long as the lower voltage level corresponding to a plateau of discharge remains stable over a predetermined interval of time, such voltage can be sufficiently high as to continue to operate the electronic timepiece. Moreover, in a battery having the two-stage characteristic of the instant invention, the inner impedance does not increase as the voltage is lowered, so that sufficient current can be generated to drive step-motors motors and the like. Thirdly, by utilizing a battery having a two-stage discharge characterisitc, a simplified detection circuit can be utilized since the threshold voltage at which a change in voltage level is detected need only be designed to fall within the range of an upper voltage level and a lower voltage level. Finally, the difficulties encountered in losing the information stored in a volatile semi-conductor memory circuit when same fails to dissipate power is avoided. Accordingly, in light of the foregoing, it is readily apparent that the instant invention provides for a highly stable, extremely reliable and easy to produce battery monitoring circuit.

It will thus be seen that the objects set forth above, among those made apparent from th preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. In an electronic timepiece including display means for displaying time in response to timekeeping signals applied thereto and for indicating a voltage level representative of impending failure of a power source in response to an indication signal applied thereto, the improvement comprising an electrochemical power source for delivering at least two characteristic voltage levels, said first voltage level corresponding to a first plateau of discharge, and a second voltage level corresponding to a last plateau of discharge being sustained essentially at said second voltage level for a predetermined interval of time prior to the ultimate failure of said electro-chemical power source, battery voltage detecting means coupled to said electro-chemical power source for detecting a change from said first voltage level to said second voltage level and producing an indication signal in response to said second voltage level, and timekeeping means coupled to said power source for being energized by said power source when same is delivering said respective characteristic voltage levels and, in response to being energized by said power source, applying timekeeping signals to said display means.

2. An electronic timepiece as claimed in claim 1, and including memory means coupled to said power source and said timekeeping means, said memory means being energized by said power source and in response thereto regulating the frequency of the timekeeping signals produced by said timekeeping means, said memory means being energized by said power source at both voltage levels delivered thereby.

3. An electronic timepiece as claimed in claim 2, wherein said memory means is a volatile semi-conductor memory circuit.

4. An electronic timepiece as claimed in claim 3, and including switching means disposed intermediate said power source and said timekeeping means, said switching means being coupled to said battery voltage detecting means for preventing the delivery of said second level voltage to said timekeeping means a second predetermined interval of time after said power source means is discharged to said second voltage level, said second predetermined interval of time being less than said first mentioned predetermined interval of time over which said plateau of discharge is essentially sustained.

5. An electronic timepiece as claimed in claim 4, and including a control means for receiving said indication signal and in response thereto producing an inhibit signal after said second predetermined interval of time, said switching means including an electronic switching element disposed intermediate said power source and said timekeeping means, said switching element defining a first switching mode wherein a closed conductive path is defined between said power source and said timekeeping circuitry, said switching element in response to an inhibit signal being applied thereto being adapted to define a second switching mode wherein an open circuit is defined between said power source means and said timekeeping means, thereby preventing said power source from delivering said second level voltage to said timekeeping means.

6. An electronic timepiece as claimed in claim 5, wherein said timekeeping means is adapted to produce a low frequency signal, and said control circuit means includes counter means coupled to said battery voltage detecting means, said counter means being further coupled to said timekeeping means, and in response to said indication signal being applied thereto, dividing said low frequency signal and producing an inhibit signal after said second predetermined interval of time.

7. An electronic timepiece as claimed in claim 1, wherein said battery voltage detecting means includes a field effect transistor coupled to said power source whereby said change in voltage level is detected by the thresehold voltage of said field-effect transistor.

8. An electronic timepiece as claimed in claim 7, wherein said battery voltage detecting means includes a resistor coupled as a load to said field-effect transistor for selectively determining the predetermined voltage level at which the battery voltage detecting means produces said indication signal.

9. An electronic timepiece as claimed in claim 1, wherein at least one electrode of said power source includes at least two different active materials, said different materials providing said multi-plateau voltage characteristic.

10. An electronic timepiece as claimed in claim 9, wherein said electrode including at least two different active materials is said negative electrode.

11. An electronic timepiece as claimed in claim 10, wherein said two materials comprising said negative electrode are zinc and cadmium.

12. An electronic timepiece as claimed in claim 11, wherein said negative electrode is comprised of about 80% to 95% zinc and 5% to 20% of cadmium.

* * * * *